US010539343B2

(12) United States Patent
Okano

(10) Patent No.: US 10,539,343 B2
(45) Date of Patent: Jan. 21, 2020

(54) HEAT SOURCE SIDE UNIT AND AIR-CONDITIONING APPARATUS

(71) Applicant: Mitsubishi Electric Corporation, Tokyo (JP)

(72) Inventor: Hiroyuki Okano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 455 days.

(21) Appl. No.: 15/105,619

(22) PCT Filed: Mar. 20, 2014

(86) PCT No.: PCT/JP2014/057808
§ 371 (c)(1),
(2) Date: Jun. 17, 2016

(87) PCT Pub. No.: WO2015/140994
PCT Pub. Date: Sep. 24, 2015

(65) Prior Publication Data
US 2016/0320100 A1 Nov. 3, 2016

(51) Int. Cl.
*F25B 13/00* (2006.01)
*F25B 49/02* (2006.01)
*F24F 1/06* (2011.01)

(52) U.S. Cl.
CPC ..... *F25B 13/00* (2013.01); *F24F 1/06* (2013.01); *F25B 49/02* (2013.01);
(Continued)

(58) Field of Classification Search
CPC ..... F25B 2313/0253; F25B 2400/13; F25B 2400/23; F25B 2313/02741; F25B 2313/0272; F25B 2313/0231
See application file for complete search history.

(56) References Cited

U.S. PATENT DOCUMENTS 5,704,219 A * 1/1998 Suzuki ..... B60H 1/00907 237/2 B
6,032,473 A * 3/2000 Morimoto ..... F25B 9/006 62/205
(Continued)

FOREIGN PATENT DOCUMENTS

JP H01-169277 A 7/1989
JP H04-359767 A 12/1992
(Continued)

OTHER PUBLICATIONS

Extended European Search Report dated Nov. 15, 2017 in the corresponding EP application No. 14885982.0.
(Continued)

*Primary Examiner* — Nelson J Nieves
(74) *Attorney, Agent, or Firm* — Posz Law Group, PLC

(57) ABSTRACT

A heat source side unit connected to load side units by pipes and constituting a refrigerant circuit, includes a compressor that compresses refrigerant and discharges the refrigerant, a heat source side heat exchanger that serves as an evaporator or a radiator, a gas-liquid separator that separates inflow refrigerant into liquid refrigerant and gas refrigerant, a liquid refrigerant outlet from which the liquid refrigerant flows out being connected to a connecting pipe at a refrigerant inflow side in a case where the heat source side heat exchanger serves as the evaporator, a sixth connecting pipe that connects a gas refrigerant outlet of the gas-liquid separator from which the gas refrigerant flows out to a pipe at a refrigerant outflow side in a case where the heat source side heat exchanger serves as the evaporator, and an expansion device that controls passage of refrigerant in the sixth connecting pipe.

6 Claims, 6 Drawing Sheets

(52) U.S. Cl.
CPC ... *F25B 2313/005* (2013.01); *F25B 2313/006* (2013.01); *F25B 2313/0231* (2013.01); *F25B 2313/0253* (2013.01); *F25B 2313/0272* (2013.01); *F25B 2313/0292* (2013.01); *F25B 2313/0294* (2013.01); *F25B 2313/02741* (2013.01); *F25B 2313/0314* (2013.01); *F25B 2400/23* (2013.01); *F25B 2600/2513* (2013.01); *F25B 2700/1931* (2013.01); *F25B 2700/1933* (2013.01)

(56) References Cited

U.S. PATENT DOCUMENTS 8,899,056 B2 * 12/2014 Kawano ..... F25B 13/00 62/149
2005/0252221 A1 * 11/2005 Mizutani ..... F25B 13/00 62/149
2008/0098758 A1 * 5/2008 Moriwaki ..... F25B 9/008 62/222
2009/0282849 A1 * 11/2009 Fujimoto ..... F25B 1/10 62/228.5
2010/0154451 A1 * 6/2010 Yamada ..... F25B 13/00 62/238.7
2010/0293975 A1 * 11/2010 Kawano ..... F25B 13/00 62/149
2012/0103003 A1 * 5/2012 Hokazono ..... F25B 13/00 62/401
2012/0285675 A1 * 11/2012 Shinozaki ..... F24F 3/06 165/207
2013/0036757 A1 * 2/2013 Okaichi ..... F25B 1/10 62/196.1
2013/0139533 A1 * 6/2013 Jeon ..... F25B 30/02 62/151
2014/0026605 A1 * 1/2014 Ishimura ..... F25B 1/00 62/222
2014/0151015 A1 * 6/2014 Sun ..... F25B 1/10 165/253
2014/0174114 A1 * 6/2014 Tamaki ..... F25B 45/00 62/129
2014/0182329 A1 * 7/2014 Yamashita ..... F25B 13/00 62/498
2015/0135756 A1 * 5/2015 Sakai ..... F25B 13/00 62/324.6
2015/0143841 A1 * 5/2015 Kawano ..... F25B 13/00 62/498
2015/0292777 A1 * 10/2015 Okano ..... F25B 5/02 62/129
2015/0300713 A1 * 10/2015 Sun ..... F25B 49/022 62/115
2015/0345842 A1 * 12/2015 Kawano ..... F25B 13/00 62/196.1
2016/0231040 A1 * 8/2016 Hellmann ..... F25B 43/00
2017/0121581 A1 * 5/2017 Horiike ..... C09K 5/045

FOREIGN PATENT DOCUMENTS

JP 2000-055482 A 2/2000
JP 2008-045837 A 2/2008
JP 2008-051425 A 3/2008
JP WO 2012160597 A1 * 11/2012 ..... F25B 1/00
KR 100965057 B1 * 6/2010
WO 2013/171783 A1 11/2013

OTHER PUBLICATIONS

International Search Report of the International Searching Authority dated Jun. 17, 2014 for the corresponding international application No. PCT/JP2014/057808 (and English translation).

* cited by examiner

HEAT SOURCE SIDE UNIT AND AIR-CONDITIONING APPARATUS

CROSS REFERENCE TO RELATED APPLICATION

This application is a U.S. national stage application of PCT/JP2014/057808 filed on Mar. 20, 2014, the contents of which are incorporated herein by reference.

TECHNICAL FIELD

The present invention relates to, for example, a heat source side unit that performs an operation in which each of a plurality of indoor units (load side units) performs a cooling operation or a heating operation (hereinafter referred to as a cooling and heating mixed operation).

BACKGROUND ART

A conventional air-conditioning apparatus performs an operation in which a cooling operation and a heating operation are performed at the same time in load side units connected to a heat source unit (heat source side unit), (see, for example, Patent Literature 1). In such an air-conditioning apparatus, a channel is switched so that an outdoor heat exchanger serves as a condenser or a condenser depending on a required cooling or heating load, and supply of refrigerant to a load side unit is switched by a relay unit.

CITATION LIST

Patent Literature

Patent Literature 1: Japanese Unexamined Patent Application Publication No. 4-359767 (page 8, FIG. 1)

SUMMARY OF INVENTION

Technical Problem

In a heating operation or a cooling and heating mixed operation mainly using a heating load, the quality of refrigerant flowing into a heat source side unit varies depending on an operation capacity and a cooling to heating ratio. Thus, although the ratio between refrigerant in a gas state (gas refrigerant) and refrigerant in a liquid state (liquid refrigerant) in the refrigerant varies, the whole amount of refrigerant is allowed to flow into an outdoor heat exchanger. Since a pressure loss in the outdoor heat exchanger increases in accordance with the flow rate of refrigerant flowing in the outdoor heat exchanger, as the amount of refrigerant increases, the pressure loss in the outdoor heat exchanger increases, and a suction density of a compressor decreases. When the suction density of the compressor decreases, a driving frequency increases for the purpose of maintaining the flow rate to obtain the same capacity. Consequently, power consumption increases, and the effect of energy saving in an operation of the entire apparatus decreases.

The present invention has been made to solve problems as described above, and has an object of providing, for example, a heat source side unit that reduces power consumption by reducing a pressure loss in a refrigerant circuit.

Solution to Problem

A heat source side unit according to the present invention is a heat source side unit connected to a load side unit for supplying a capacity to a load by a pipe and constituting a refrigerant circuit, and includes: a compressor that compresses refrigerant and discharges the refrigerant; a heat source side heat exchanger that serves as an evaporator or a radiator; a gas-liquid separator that separates inflow refrigerant into liquid refrigerant and gas refrigerant, a liquid refrigerant outlet from which the liquid refrigerant flows out being connected to a pipe at a refrigerant inflow side in a case where the heat source side heat exchanger serves as the evaporator; a bypass pipe that connects a gas refrigerant outlet of the gas-liquid separator from which the gas refrigerant flows out to a pipe at a refrigerant outflow side in the case where the heat source side heat exchanger serves as the evaporator; and an expansion device that controls passage of the refrigerant in the bypass pipe.

Advantageous Effects of Invention

The heat source side unit according to the present invention includes the gas-liquid separator, the bypass pipe, and the expansion device, and bypasses refrigerant that does not need to pass through the outdoor heat exchanger serving as the evaporator. Thus, a decrease in suction density of refrigerant in the compressor can be reduced by reducing a pressure loss occurring in a low-pressure channel, thereby reducing power consumption.

DESCRIPTION OF EMBODIMENTS

Figure 1:
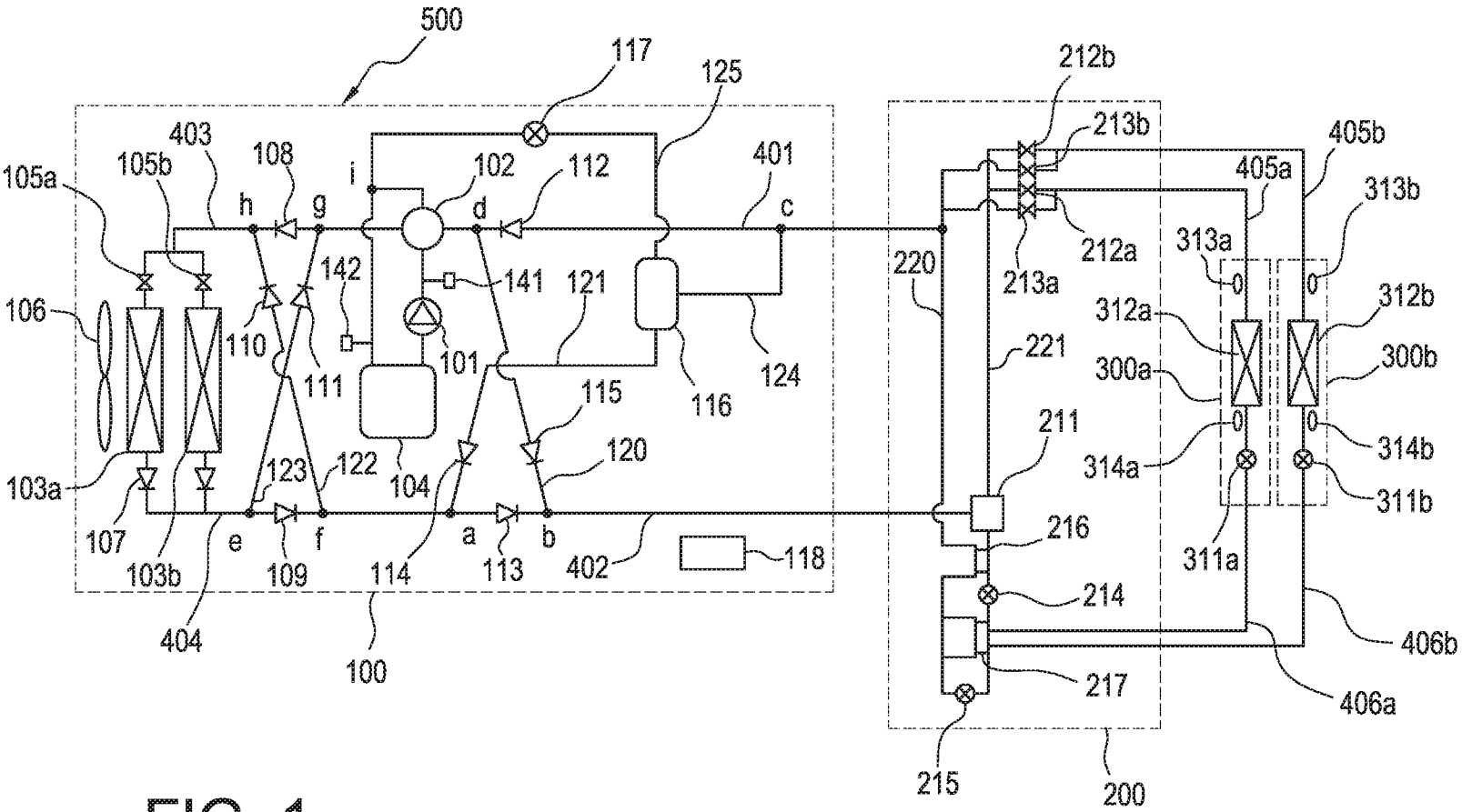
FIG. 1 schematically illustrates an example refrigerant circuit configuration of an air-conditioning apparatus according to Embodiment of the present invention.

A refrigeration cycle system according to embodiments of the invention will be described hereinafter with reference to, for example, the drawings. In the drawings including FIG. 1, the same reference characters designate the same or like components, and the same holds for the entire description of the embodiments. The configurations of components in the entire specification are merely examples, and the present invention is not limited to these examples. In particular, a combination of components is not limited to those of embodiments, and components in one embodiment may be applied to another embodiment. Similar devices distinguished by using suffixes, for example, may be collectively referred to without the suffixes when these devices do not need to be individually distinguished or specified. In the attached drawings, the size relationships among components may differ from those in actual application. The levels of, for example, temperature and pressure are not determined based on specific absolute values, and are relative values determined based on the states, operations, and other factors in, for example, a system or a device.

Embodiment 1

FIG. 1 schematically illustrates an example refrigerant circuit configuration of an air-conditioning apparatus 500 according to Embodiment 1 of the present invention. Referring to FIG. 1, a refrigerant circuit configuration of the air-conditioning apparatus 500 will be described. The air-conditioning apparatus 500 is placed in, for example, a building or an apartment, and performs a cooling and heating mixed operation by using a refrigeration cycle (heat pump cycle) for circulating refrigerant.

The air-conditioning apparatus 500 includes a heat source side unit 100, a plurality of (two in FIG. 1) load side units 300 (load side units 300*a* and 300*b*), and a refrigerant control unit 200. The refrigerant control unit 200 is disposed between the heat source side unit 100 and the load side units 300 and switches a flow of refrigerant so that each of the load side units 300 can selectively perform a cooling operation or a heating operation. Here, in the air-conditioning apparatus 500, the heat source side unit 100 is connected to the refrigerant control unit 200 by two pipes (a high-pressure pipe 402 and a low-pressure pipe 401), and the refrigerant control unit 200 is connected to each of the load side units 300 by two pipes (a liquid pipe 406 (a liquid pipe 406*a* or 406*b*) and a gas pipe 405 (a gas pipe 405*a* or 405*b*)), thereby forming a refrigeration cycle.

[Heat Source Side Unit 100]

The heat source side unit 100 has a function of supplying cooling energy or heating energy to the load side units 300.

The heat source side unit 100 includes a compressor 101, a four-way switching valve 102 that is a channel switching device, a heat source side heat exchanger 103, and an accumulator 104. These components are serially connected, thereby constituting a part of a main refrigerant circuit. The heat source side unit 100 also includes a check valve 108, a check valve 109, a check valve 110, a check valve 111, a check valve 112, a check valve 113, a check valve 114, a check valve 115, a first connecting pipe 120, a second connecting pipe 121, a third connecting pipe 122, a fourth connecting pipe 123, and a fifth connecting pipe 124. Thus, irrespective of requests from the load side units 300, a flow of refrigerant into the refrigerant control unit 200 can be made in one direction. The second connecting pipe 121 and the fifth connecting pipe 124 are connected to each other through a gas-liquid separator 116. The sixth connecting pipe 125 is connected to a primary side of the accumulator 104 as a gas-side outflow pipe of the gas-liquid separator 116 to be a bypass pipe. On the sixth connecting pipe 125, an expansion device 117 for adjusting a flow rate of refrigerant is disposed. The heat source side unit 100 further includes shut-off valves 105 (a shut-off valve 105*a* and a shut-off valve 105*b*), a check valve 107, and a heat source side fan 106.

The compressor 101 sucks low-temperature, low-pressure gas refrigerant, compresses the refrigerant into high-temperature, high-pressure gas refrigerant so that the refrigerant is allowed to circulate in the system, thereby performing an operation of the air-conditioning apparatus. The compressor 101 may be, for example, an inverter compressor whose capacity can be controlled. However, the compressor 101 is not limited to an inverter compressor whose capacity can be controlled. For example, the compressor 101 may be, for example, a compressor as a combination of a constant-speed compressor and an inverter compressor.

The four-way switching valve 102 is disposed at a discharge side of the compressor 101, and switches a refrigerant channel between a cooling operation (a cooling-only operation mode or a cooling main operation mode) and a heating operation (a heating-only operation mode or a heating main operation mode). The four-way switching valve 102 controls a flow of refrigerant so that the heat source side heat exchanger 103 serves as an evaporator or a condenser depending on an operation mode.

The heat source side heat exchangers 103 (the heat source side heat exchanger 103*a* and the heat source side heat exchanger 103*b*) exchange heat between a heat medium (e.g., ambient air or water) and refrigerant. In a heating operation, the heat source side heat exchangers 103 serve as evaporators, and evaporate and gasify the refrigerant. In a cooling operation, the heat source side heat exchangers 103 serve as condensers (radiators), and condense and liquefy the refrigerant. In a case where the heat source side heat exchangers 103 are air-cooled heat exchangers as in Embodiment 1, an air-sending device such as the heat source side fan 106 is provided. For example, a controller 118 described later controls a rotation speed of the heat source side fan 106 to control a condensing capacity or an evaporative capacity of the heat source side heat exchangers 103. In a case where the heat source side heat exchangers 103 are water-cooled heat exchangers, the controller 118 controls a rotation speed of a water circulation pump (not shown) to control a condensing capacity or an evaporative capacity of the heat source side heat exchangers 103. The accumulator 104 is disposed at a suction side of the compressor 101, and has a function of separating liquid refrigerant and gas refrigerant from each other and a function of storing surplus refrigerant.

The first connecting pipe 120 is a pipe connecting the high-pressure pipe 402 at a downstream side of the check valve 113 and the low-pressure pipe 401 at a downstream side of the check valve 112 to each other. The fifth connecting pipe 124 is a pipe connecting the second connecting pipe 121 and the low-pressure pipe 401 to each other through the gas-liquid separator 116. As will be described later, through this pipe, refrigerant that has flowed from the refrigerant control unit 200 mainly passes during the heating operation. In FIG. 1, relative locations of components can be different from those in actual application. For example, the gas-liquid separator 116 is disposed at a location higher than the bottom of the low-pressure pipe 401. In this manner, to prevent accumulation of oil, the gas-liquid separator 116 is preferably disposed at a location higher than the low-pressure pipe 401. The sixth connecting pipe 125 is a pipe connecting a suction side (also serving as an inflow side of the accumulator 104 and a secondary side (refrigerant outflow side) of the heat source side heat exchanger 103) of the compressor 101 to a gas side outlet of the gas-liquid separator 116 through the expansion device 117. The second connecting pipe 121 is a pipe connecting the high-pressure pipe 402 at an upstream side of the check valve 113 to a liquid side outlet of the gas-liquid separator 116.

The gas-liquid separator 116 separates liquid refrigerant and gas refrigerant from each other. The gas-liquid separator 116 includes a liquid side outlet and a gas side outlet. The liquid side outlet is connected to the second connecting pipe 121. On the other hand, as described above, the gas side outlet is connected to an inflow side of the accumulator 104 through the expansion device 117 by using the sixth connecting pipe 125. The expansion device 117 controls the amount of refrigerant passing through the sixth connecting pipe 125. Control of the amount of refrigerant passing through the sixth connecting pipe 125 can control the amount of refrigerant passing through the heat source side heat exchanger 103. In Embodiment 1, the expansion device 117 is, for example, an electronic expansion valve whose opening degree can be adjusted based on an instruction of the controller 118, for example. The opening degree of the expansion device 117 may be fixed. The expansion device 117 may include two or more fixed expansion devices or a combination of fixed expansion devices and variable expansion devices.

Here, as illustrated in FIG. 1, a joint between the second connecting pipe 121 and the high-pressure pipe 402 is defined as a joint a. A joint between the first connecting pipe 120 and the high-pressure pipe 402 is defined as a joint b (disposed downstream of the joint a). A joint between the fifth connecting pipe 124 and the low-pressure pipe 401 is defined as a joint c. A joint between the first connecting pipe 120 and the low-pressure pipe 401 is defined as a joint d (disposed downstream of the joint c).

The gas-liquid separator 116 may be disposed on the low-pressure pipe 401 without providing the fifth connecting pipe 124. As illustrated in FIG. 1, for example, in a configuration where the gas-liquid separator 116 is disposed on a pipe branching off from the low-pressure pipe 401 and connected to the joint a, however, while the heat source side heat exchanger 103 serves as a condenser (in the cooling operation), a pressure decrease at a low-pressure side caused by a pressure loss in the gas-liquid separator 116 can be suppressed.

The check valve 112 is disposed between the joint c and the joint d, and allows refrigerant to flow only in a direction from the refrigerant control unit 200 to the heat source side unit 100. The check valve 113 is disposed between the joint a and the joint b, and allows refrigerant to flow only in a direction from the heat source side unit 100 to the refrigerant control unit 200. The check valve 115 is disposed on the first connecting pipe 120, and allows refrigerant to flow only in a direction from the joint d to the joint b. The check valve 114 is disposed on the second connecting pipe 121, and allows refrigerant to flow only in a direction from the joint c to the joint a.

The third connecting pipe 122 connects the high-pressure pipe 402 at a downstream side of the check valve 109 and the connecting pipe 403 at a downstream side of the check valve 108. The fourth connecting pipe 123 connects the connecting pipe 404 at an upstream side of the check valve 109 to the connecting pipe 403 at an upstream side of the check valve 108.

As illustrated in FIG. 1, a joint between the fourth connecting pipe 123 and the connecting pipe 404 is defined as a joint e. A joint between the fourth connecting pipe 123 and the high-pressure pipe 402 is defined as a joint f (disposed downstream of the joint e). A joint between the fourth connecting pipe 123 and the connecting pipe 403 is defined as a joint g. A joint between the third connecting pipe 122 and the connecting pipe 404 is defined as a joint h (disposed downstream of the joint g). A joint between the sixth connecting pipe 125 and a suction side pipe of the accumulator 104 is defined as a joint i.

The check valve 108 is disposed between the joint g and the joint h, and allows refrigerant to flow only in a direction from the four-way switching valve 102 to the heat source side heat exchanger 103. The check valve 109 is disposed between the joint e and the joint f, and allows refrigerant to flow only in a direction from the heat source side heat exchanger 103 to the refrigerant control unit 200. The check valve 107 is disposed between the heat source side heat exchanger 103*a* and the check valve 109, and allows refrigerant to flow only in a direction from the heat source side heat exchanger 103*a* to the check valve 109.

The shut-off valves 105*a* and 105*b* are disposed upstream of the heat source side heat exchangers 103*a* and 103*b*, and allow or prevent a flow of refrigerant by controlling opening and closing of the valves. By controlling opening and closing of the shut-off valve 105*a*, a flow of refrigerant into the heat source side heat exchangers 103*a* and 103*b* is controlled.

The heat source side unit 100 includes a high pressure sensor 141 for detecting a pressure (high pressure) of refrigerant discharged from the compressor 101. The heat source side unit 100 also includes a low pressure sensor 142 for detecting a pressure (low pressure) of refrigerant sucked into the compressor 101. The high pressure sensor 141 and the low pressure sensor 142 send a signal concerning a detected pressure to the controller 118 for controlling an operation of the air-conditioning apparatus 500. Based on the high pressure and the low pressure, the controller 118 controls, for example, a driving frequency of the compressor 101, a rotation speed of the air-sending device, and switching of the four-way switching valve 102.

The controller 118 controls the air-conditioning apparatus 500, mainly devices incorporated in the heat source side unit 100. Here, the controller 118 is constituted by, for example, a microcomputer. The controller 118 includes a control computation unit such as a central processing unit (CPU). The controller 118 also includes a storage unit (not shown) and includes data on a procedure of, for example, control as a program. The control computation unit executes a process based on data of the program to control, for example, devices constituting the heat source side unit 100. In Embodiment 1, the controller 118 is disposed in the heat source side unit 100. However, the controller 118 may be disposed at any location as long as the controller 118 controls, for example, the devices.

[Refrigerant Control Unit 200]

The refrigerant control unit 200 is disposed between the heat source side unit 100 and the load side units 300, and switches a flow of refrigerant depending on operation situations of the load side units 300. Here, in FIG. 1, "a" or "b" is added to the ends of reference characters for some devices in the refrigerant control unit 200. The "a" and "b" are used to distinguish a device connected to the "load side unit 300*a*" and a device connected the "load side unit 300*b*" from each other as described later. In the following description, suffixes "a" and "b" to reference characters are omitted in some cases. The case where "a" and "b" are omitted includes both a case where the device is connected to the "load side unit 300*a*" and a case where the device is connected to the "load side unit 300*b*."

The refrigerant control unit 200 is connected to the heat source side unit 100 by the high-pressure pipe 402 and the low-pressure pipe 401, and is connected to each of the load side units 300 by the liquid pipes 406 and the gas pipes 405. The refrigerant control unit 200 includes a gas-liquid separator 211, first shut-off valves 212 (first shut-off valves 212*a* and 212*b*), second shut-off valves 213 (second shut-off valves 213*a* and 213*b*), a first expansion device 214, a second expansion device 215, a first refrigerant heat exchanger 216, and a second refrigerant heat exchanger 217.

The refrigerant control unit 200 includes a connecting pipe 220 branched off from a pipe downstream of a primary side (a side in which refrigerant that has passed through the first expansion device 214 flows) of the second refrigerant heat exchanger 217 and connected to the low-pressure pipe 401.

The gas-liquid separator 211 is provided on the high-pressure pipe 402, and has a function of separating two-phase refrigerant that has flowed through the high-pressure pipe 402 into gas refrigerant and liquid refrigerant. The gas refrigerant separated by the gas-liquid separator 211 is supplied to the first shut-off valve 212 through the connecting pipe 221, and the liquid refrigerant separated by the gas-liquid separator 211 is supplied to the first refrigerant heat exchanger 216.

The first shut-off valve 212 is used for controlling supply of refrigerant to the load side units 300 in each operation mode, and is disposed between the connecting pipe 221 and the gas pipes 405. Specifically, the first shut-off valve 212 is connected to the gas-liquid separator 211 at one end, is connected to the indoor heat exchangers 312 of the load side units 300 at the other end, and controls whether to pass refrigerant or not by opening or closing the valve 212.

The second shut-off valve 213 is also used for controlling supply of refrigerant to the load side units 300 in each operation mode, and is disposed between the gas pipes 405 and the low-pressure pipe 401. Specifically, the second shut-off valve 213 is connected to the low-pressure pipe 401 at one end, is connected to the indoor heat exchangers 312 of the load side units 300 at the other end, and allows or prevents flowing of refrigerant by opening or closing the valve 213.

The first expansion device 214 is disposed on a pipe connecting the gas-liquid separator 211 and the liquid pipes 406, that is, between the first refrigerant heat exchanger 216 and the second refrigerant heat exchanger 217, functions as a pressure reducing valve or an expansion valve, and reduces the pressure of refrigerant to expand the refrigerant. The first expansion device 214 preferably including, for example, a device having a variable opening degree, such as a fine flow rate control device using an electronic expansion valve, or an inexpensive refrigerant flow rate adjusting unit such as a capillary tube.

The second expansion device 215 is disposed at an upstream side of the connecting pipe 220 at the secondary side of the second refrigerant heat exchanger 217, functions as a pressure reducing valve or an expansion valve, and reduces the pressure of refrigerant to expand the refrigerant. In a manner similar to the first expansion device 214, the second expansion device 215 preferably including, for example, a device having a variable opening degree, such as a fine flow rate control device using an electronic expansion valve, or an inexpensive refrigerant flow rate adjusting unit such as a capillary tube.

The first refrigerant heat exchanger 216 exchanges heat between refrigerant flowing at a primary side (a side in which liquid refrigerant separated by the gas-liquid separator 211 flows) and refrigerant flowing at a secondary side (a side in which refrigerant that has flowed through the second expansion device 215 and then flowed out from the second refrigerant heat exchanger 217 on the connecting pipe 220).

The second refrigerant heat exchanger 217 exchanges heat between refrigerant flowing at a primary side (downstream of the first expansion device 214) and refrigerant flowing at a secondary side (downstream of the second expansion device 215).

Since the refrigerant control unit 200 includes the first expansion device 214, the second expansion device 215, the first refrigerant heat exchanger 216, and the second refrigerant heat exchanger 217, the first refrigerant heat exchanger 216 and the second refrigerant heat exchanger 217 exchange heat between refrigerant flowing in a main circuit (at the primary side) and refrigerant flowing in the connecting pipe 220 (at the secondary side), thereby obtaining subcooling of the refrigerant flowing in the main circuit. The amount of bypassing is controlled to obtain appropriate subcooling in an outlet at the primary side of the second refrigerant heat exchanger 217, by adjusting the opening degree of the second expansion device 215.

[Load Side Unit 300]

The load side units 300 supply cooling energy or heating energy from the heat source side unit 100 to the cooling load or the heating load. For example, in FIG. 1, "a" is added to the end of each reference character designating a component included in the "load side unit 300*a*" and "b" is added to the end of each reference character designating a component included in the "load side unit 300*b*". In the following description, "a" and "b" at the end of each reference character is omitted in some cases. In such cases, the corresponding components are included in both the load side units 300*a* and the load side units 300*b*.

The load side units 300 include indoor heat exchangers 312 (indoor heat exchangers 312*a* and 312*b*) and indoor expansion devices 311 (indoor expansion devices 311*a* and 311*b*) that are connected in series. The indoor heat exchangers 312 are preferably provided with air-sending devices (not shown) for supplying air. The indoor heat exchangers 312 may exchange heat between refrigerant and a heat medium different from refrigerant, such as water.

Each of the indoor heat exchangers 312 exchanges heat between a heat medium (e.g., ambient air or water) and refrigerant, serves as a condenser (radiator) to condense and liquefy the refrigerant in the heating operation, and serves as an evaporator to evaporate and gasify the refrigerant in the cooling operation. The indoor heat exchanger 312 is generally provided with an unillustrated fan, and a condensing capacity or an evaporative capacity is controlled by adjusting a rotation speed of the fan.

Each of the indoor expansion devices 311 function as pressure reducing valves and expansion valves, and reduce a pressure of refrigerant to expand the refrigerant. Each of the indoor expansion devices 311 preferably including, for example, a device having a variable opening degree, such as a fine flow rate controller using an electronic expansion valve, or an inexpensive refrigerant flow rate adjusting unit such as a capillary tube.

The load side units 300 include at least temperature sensors 314 (temperature sensors 314*a* and 314*b*) for detecting temperatures of refrigerant pipes between the indoor expansion devices 311 and the indoor heat exchangers 312 and temperature sensors 313 (temperature sensors 313*a* and 313*b*) for detecting temperatures of refrigerant pipes between the indoor heat exchangers 312 and the first shut-off valve 212 and the second shut-off valve 213. Information (temperature information) detected by these sensors is sent to the controller 118 for controlling an operation of the air-conditioning apparatus 500 to be used for control of actuators. That is, information from the temperature sensors 313 and the temperature sensors 314 is used for controlling, for example, opening degrees of the indoor expansion devices 311 included in the load side units 300 and rotation speeds of unillustrated air-sending devices.

Here, the compressor 101 only needs to compress sucked refrigerant into a high-pressure state, and the type of the compressor 101 is not specifically limited. For example, the compressor 101 may be of various types such as a reciprocation type, a rotary type, a scroll type, and a screw type. The type and shape of the gas-liquid separator 116 are not specifically limited as long as the gas-liquid separator 116 separates two-phase refrigerant into a gaseous phase and a liquid phase, and may employ gravity separation or centrifugal separation, for example. The separation efficiency of the gas-liquid separator 116 is not specifically limited, either, and may be selected depending on an amount of liquid back and the amount of refrigerant circulation allowable in a system, a target performance value, and a target cost, for example. The type of refrigerant used in the air-conditioning apparatus 500 is not specifically limited, and may be, for example, natural refrigerant such as carbon dioxide, hydrocarbon, or helium, alternative refrigerant not containing chlorine, such as HFC410A. HFC407C, or HFC404A, fluorocarbon refrigerant used in existing products, such as R22 or R134a.

In the example of FIG. 1, the controller 118 for controlling an operation of the air-conditioning apparatus 500 is included in the heat source side unit 100. Alternatively, the controller 118 may be included in the refrigerant control unit 200 or one of the load side units 300. The controller 118 may be disposed outside the heat source side unit 100, the refrigerant control unit 200, and the load side units 300. The controller 118 may be divided into a plurality of units depending on functions, which are individually disposed in the heat source side unit 100, the refrigerant control unit 200, and the load side units 300. In this case, controllers are preferably connected wirelessly or by wire so that the controllers can communicate with one another.

An operation of the air-conditioning apparatus 500 will now be described.

The air-conditioning apparatus 500 receives a cooling request and a heating request from, for example, a remote controller placed in a room, for example. In response to the request, the air-conditioning apparatus 500 performs an air-conditioning operation in one of four operation modes. The four operation modes include a cooling-only operation mode in which all the load side units 300 issue cooling operation requests, a cooling main operation mode in which both a cooling operation request and a heating operation request are issued and it is determined that a load to be processed by the cooling operation is larger than a load to be processed by the heating operation, a heating main operation mode in which both a cooling operation request and a heating operation request are issued and it is determined that the heating load is larger than the cooling load, and a heating-only operation mode in which all the load side units 300 issue heating operation requests.

First, a heating operation (an operation in the heating-only operation mode or the heating main operation mode) will be described.

[Heating-Only Operation Mode]

Figure 2:
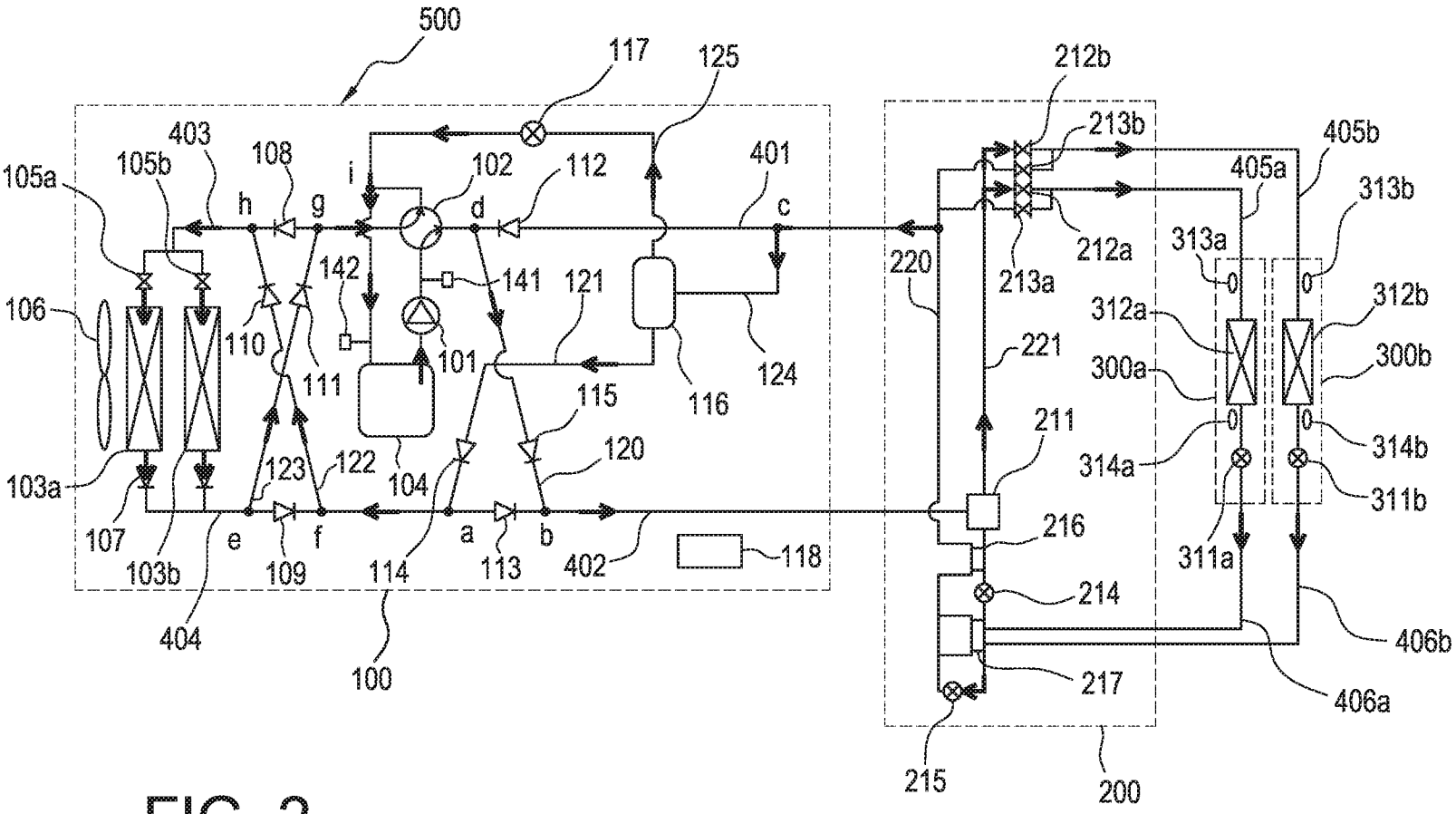
FIG. 2 is a refrigerant circuit diagram illustrating a flow of refrigerant in an operation in a heating-only operation mode of the air-conditioning apparatus according to Embodiment of the present invention.

FIG. 2 illustrates a flow of refrigerant in the heating-only operation mode of the air-conditioning apparatus 500 according to Embodiment 1 of the present invention. Referring to FIG. 2, an operation of the air-conditioning apparatus 500 in the heating-only operation mode will be described.

The compressor 101 compresses low-temperature, low-pressure refrigerant and discharges high-temperature, high-pressure gas refrigerant. The high-temperature, high-pressure gas refrigerant discharged from the compressor 101 passes through the four-way switching valve 102 and flows into the high-pressure pipe 402 through the check valve 115. Then, the refrigerant flows out of the heat source side unit 100. The high-temperature, high-pressure gas refrigerant that has flowed out of the heat source side unit 100 passes the connecting pipe 221 by way of the gas-liquid separator 211 of the refrigerant control unit 200. In the heating-only operation mode, the first shut-off valve 212 is open and the second shut-off valve 213 is closed. Thus, the high-temperature, high-pressure gas refrigerant reaches the load side units 300 through the first shut-off valve 212 and the gas pipes 405.

The gas refrigerant that has flowed into the load side units 300 flows into the indoor heat exchangers 312 (the indoor heat exchanger 312*a* and the indoor heat exchanger 312*b*). Since the indoor heat exchangers 312 serve as condensers, refrigerant exchanges heat with ambient air to be condensed and liquefied. At this time, the refrigerant rejects heat to the ambient air so that an air-conditioned space such as a room is heated. Thereafter, liquid refrigerant that has flowed out of the indoor heat exchangers 312 is subjected to pressure reduction in the indoor expansion devices 311 (the indoor expansion device 311*a* and the indoor expansion device 311*b*), and flows out of the load side units 300.

The liquid refrigerant subjected to pressure reduction in the indoor expansion devices 311, flows into the liquid pipes 406 (the liquid pipe 406*a* and the liquid pipe 406*b*), and then flows into the refrigerant control unit 200. The liquid refrigerant that has flowed into the refrigerant control unit 200 reaches the low-pressure pipe 401 through the second expansion device 215 by way of the connecting pipe 220. The refrigerant flowing in the low-pressure pipe 401 flows out of the refrigerant control unit 200 and then returns to the heat source side unit 100.

The refrigerant that has returned to the heat source side unit 100 flows into the gas-liquid separator 116. Here, the refrigerant is separated into gas refrigerant and liquid refrigerant. The obtained gas refrigerant passes through the sixth connecting pipe 125, and flows into the accumulator 104 through the expansion device 117. On the other hand, the liquid refrigerant obtained by separation in the gas-liquid separator 116 passes through the second connecting pipe 121, and reaches the heat source side heat exchangers 103 (the heat source side heat exchanger 103*a* and the heat source side heat exchanger 103*b*) through the check valve 114 and the check valve 110. At this time, the shut-off valves 105 (the shut-off valve 105*a* and the shut-off valve 105*b*) are open. Since the heat source side heat exchangers 103 serve as evaporators, refrigerant exchanges heat with ambient air to be evaporated and gasified. Thereafter, the refrigerant that has flowed out of the heat source side heat exchangers 103 flows into the accumulator 104 by way of the four-way switching valve 102. Then, the gas refrigerant in the accumulator 104 is sucked by the compressor 101 and is allowed to circulate in the system, thereby obtaining a refrigeration cycle. In the foregoing manner, the air-conditioning apparatus 500 performs an operation in the heating-only operation mode.

Here, in the heating-only operation mode, control of the expansion device 117 by the controller 118 will be described. In the heating-only operation, suppose the quality of refrigerant at the inlet of the gas-liquid separator 116 is x. In this case, a gas refrigerant among Gg is $Gg=Gr \cdot x$ where Gr is an inlet refrigerant flow rate in the gas-liquid separator 116.

Based on, for example, a load side heat exchanger outlet enthalpy ho calculated from the high pressure sensor 141 and the temperature sensor 314, a saturated liquid enthalpy hl estimated from the low pressure sensor 142, and a saturation gas enthalpy hg, the quality x can be obtained from Equation (1):

[Math. 1]

$$x=(ho-h1)/(hg-hl) \quad (1)$$

Suppose a channel resistance from the gas-liquid separator 116 to the joint i is Cvg, the channel resistance Cvg is expressed by Equation (2) below. Suppose a channel resistance from the second connecting pipe 121 to the joint i by way of the heat source side heat exchangers 103 is Cvl, a channel resistance Cvl is expressed by Equation (3) below.

[Math. 2]

$$Cvg=\alpha\cdot Gg/\rho g/\Delta Pg^{1/2} \quad (2)$$

[Math. 3]

$$Cvl=\beta\cdot Gl/\rho l/\Delta Pl^{1/2} \quad (3)$$

where ΔPg=ΔPl. The liquid refrigerant amount Gl is Gl=Gr·(1−x). Thus, in an ideal case where gas refrigerant and liquid refrigerant are completely separated so that only the gas refrigerant flows from the sixth connecting pipe to the joint i by way of the expansion device 117 and only the liquid refrigerant flows from the second connecting pipe 121 into the joint i by way of the heat source side heat exchanger 103, Equation (4) below is established:

[Math. 4]

$$(Cvg/Cvl)\propto\{x/(1-x)\} \quad (4)$$

The channel resistance Cvl is determined based on a configuration from the second connecting pipe 121 to the joint i by way of the heat source side heat exchangers 103. Thus, the resistance can be obtained by a previous process such as evaluation or calculation. In the same unit, the channel resistance Cvl is constant. Here, a variable expansion device may be employed to enable control of an opening degree (i.e., the channel resistance Cvg) in accordance with the quality in an operation. The quality of refrigerant flowing into the gas-liquid separator 116 is approximately constant during an operation. Thus, in a case where the expansion device 117 is a fixed expansion device, Equation (4) may be satisfied in accordance with the quality of refrigerant flowing into the gas-liquid separator 116.

[Heating Main Operation Mode]

Figure 3:
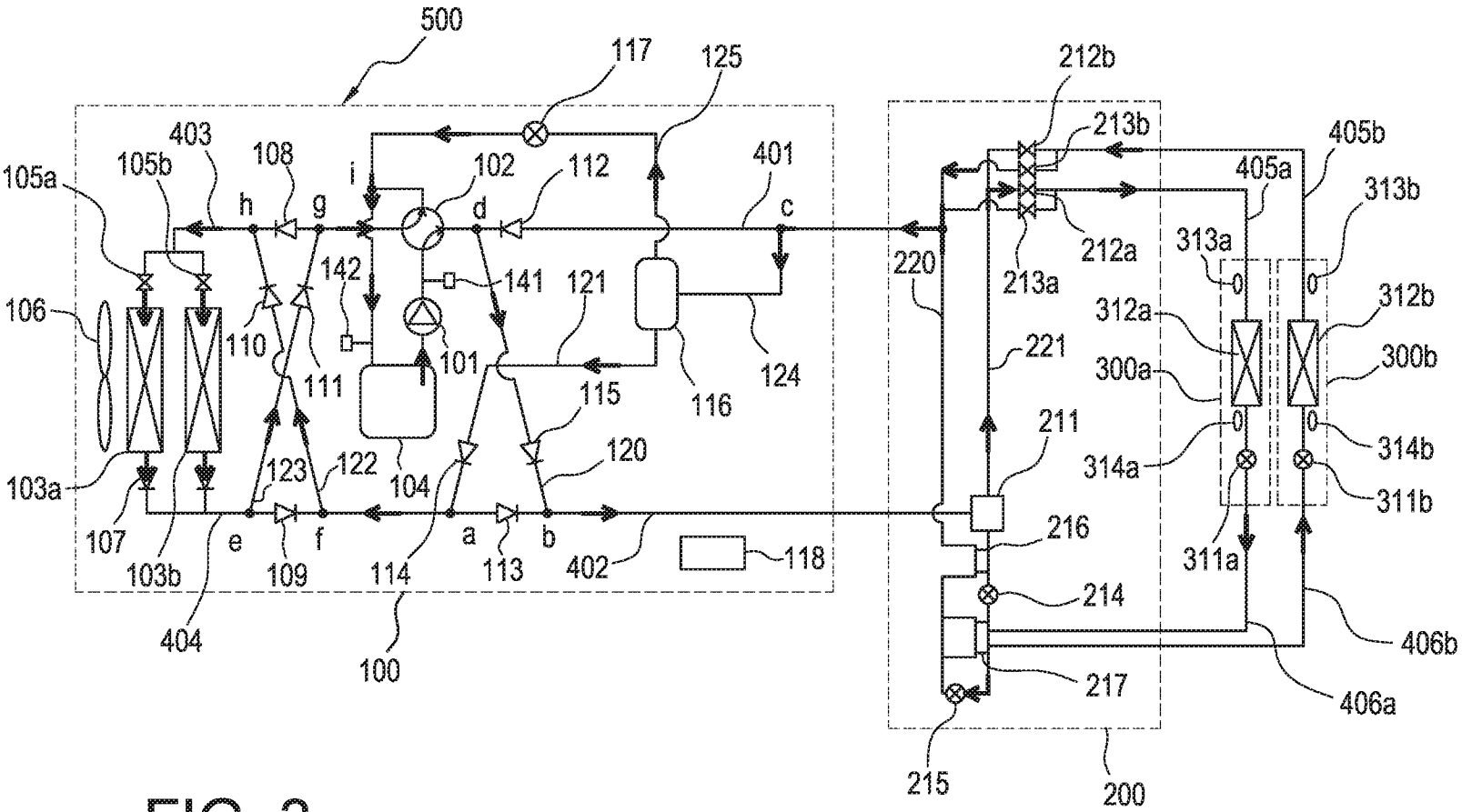
FIG. 3 is a refrigerant circuit diagram illustrating a flow of refrigerant in an operation in a heating main operation mode of the air-conditioning apparatus according to Embodiment of the present invention.

FIG. 3 illustrates a flow of refrigerant in the heating main operation mode of the air-conditioning apparatus 500 according to Embodiment 1 of the present invention. In a case where some of the load side units 300 perform cooling operations, the other of the load side units 300 perform heating operations, and a heating load is larger than a cooling load, an operation in the heating main operation mode is performed. Referring to FIG. 3, an operation of the air-conditioning apparatus 500 in the heating main operation mode will be described. Here, an operation in the heating main operation mode in a case where the load side unit 300*a* performs heating and the load side unit 300*b* performs cooling.

A flow of refrigerant before the refrigerant passes through the load side unit 300*a* performing heating is the same as that in the operation in the heating-only operation mode. Liquid refrigerant that has been liquefied by heat exchange by the indoor heat exchanger 312*a* and passed through the liquid pipe 406*a*, is subjected to subcooling by the second refrigerant heat exchanger 217. Then, the refrigerant passes through the liquid pipes 406*b* and reaches the load side unit 300*b* performing cooling. The refrigerant that has flowed into the load side unit 300*b* is subjected to pressure reduction in the indoor expansion device 311*b*. The refrigerant subjected to pressure reduction in the indoor expansion device 311*b* flows into the indoor heat exchanger 312*b*. Since the indoor heat exchanger 312*b* serves as an evaporator, refrigerant exchanges heat with ambient air to be evaporated and gasified. At this time, the refrigerant takes heat from the ambient air so that the room is cooled. Thereafter, the refrigerant that has flowed out of the load side unit 300*b* flows into the connecting pipe 220 through the second shut-off valve 213*b*. The refrigerant merges with refrigerant that has flowed in the connecting pipe 220 through the first expansion device 214 and the second expansion device 215 to be subjected to subcooling in the second refrigerant heat exchanger 217, and the resulting refrigerant reaches the low-pressure pipe 401.

The refrigerant that has returned to the heat source side unit 100 through the low-pressure pipe 401 reaches the heat source side heat exchangers 103 (the heat source side heat exchanger 103*a* and the heat source side heat exchanger 103*b*) through the check valve 114 and the check valve 110. Here, the shut-off valves 105 (the shut-off valve 105*a* and the shut-off valve 105*b*) are open. Since the heat source side heat exchangers 103 serve as evaporators, refrigerant exchanges heat with ambient air to be evaporated and gasified. Then, refrigerant that has flowed out of the heat source side heat exchangers 103 flows into the accumulator 104 by way of the four-way switching valve 102. Thereafter, refrigerant in the accumulator 104 is sucked by the compressor 101 and is allowed to circulate in the system, thereby obtaining a refrigeration cycle. In the foregoing manner, the air-conditioning apparatus 500 performs the heating main operation mode.

Figure 4:
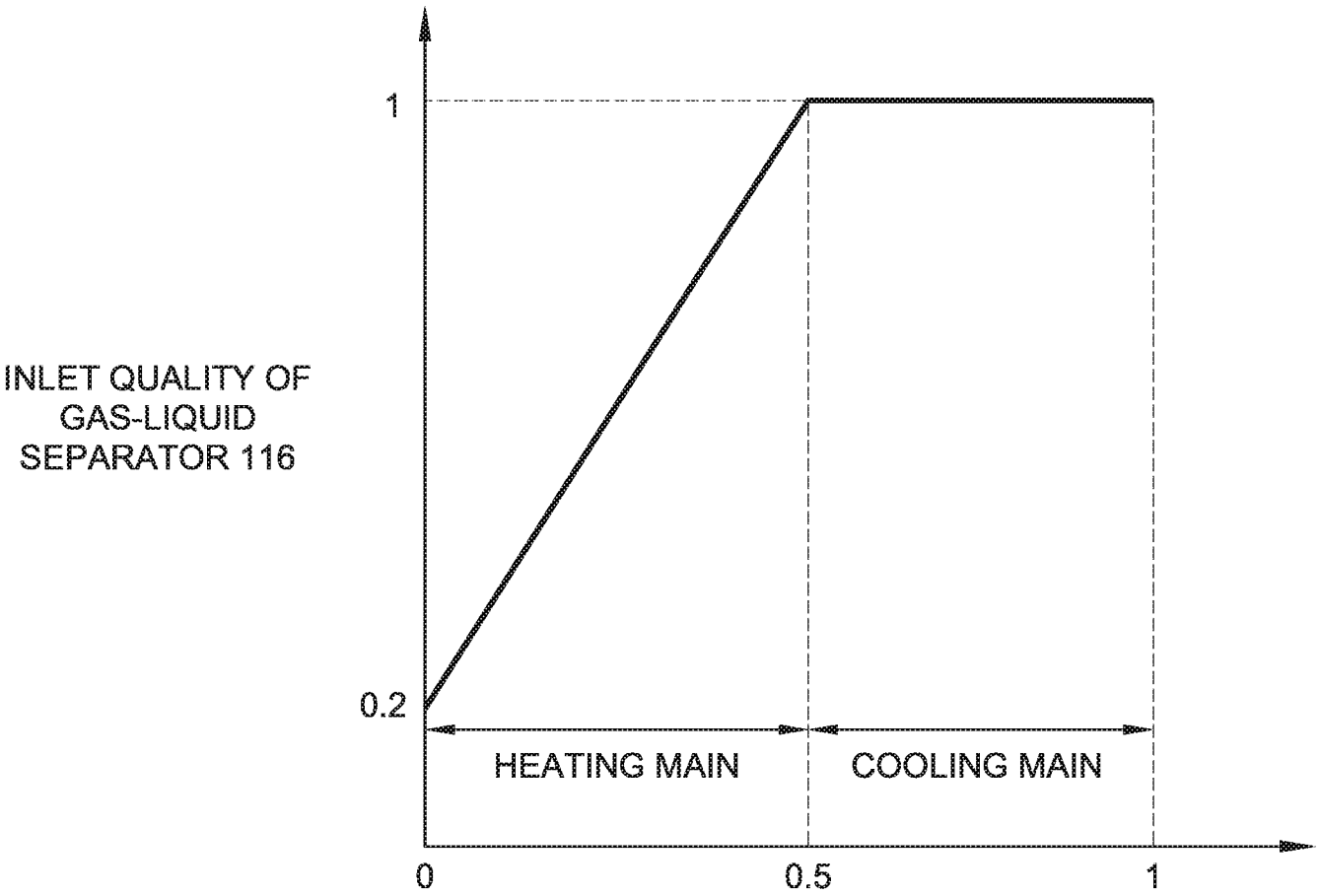
FIG. 4 shows a relationship between a cooling operation ratio and a quality in the air-conditioning apparatus according to Embodiment of the present invention.

FIG. 4 shows a relationship between a cooling operation ratio and a quality in the air-conditioning apparatus 500 according to Embodiment 1 of the present invention. Control of the expansion device 117 by the controller 118 in the heating main operation mode will be described. A channel resistance Cvl necessary for the expansion device 117 can be obtained by Equation (3) described above. At this time, in the heating main operation mode, an inlet quality x of the gas-liquid separator 116 is determined based on a ratio between a heating load and a cooling load from FIG. 4.

Suppose a ratio of a cooling load Qc to a total load Qt (=heating load Qh+cooling load Qc) is a cooling load ratio, if the cooling load Qc is equal to the heating load Qh (i.e., cooling load ratio=0.5), a total heat recovery operation is performed, and an inlet quality of the gas-liquid separator 116 is 1. As the cooling load ratio decreases, the inlet quality of the gas-liquid separator 116 approaches a quality of refrigerant in an operation in the heating-only operation mode. In an operation in the heating main operation mode, the controller 118 controls the opening degree of the expansion device 117 so that gas refrigerant included in refrigerant having a quality in accordance with the cooling load ratio flows.

As a method for obtaining a cooling load ratio, for example, a difference between an actual inlet temperature and an outlet temperature of the load side units 300 and capacities of the load side unit 300 performing cooling and the load side unit 300 performing heating based on an airflow rate set value are calculated so that a cooling load ratio is obtained. As a simple method, for example, the cooling load ratio can be computed from the capacity code of the load side unit 300 performing heating and the capacity code of the load side unit 300 performing cooling. For example, the expansion device 117 having a variable opening degree enables control of the opening degree in accordance with the cooling load ratio in the heating main operation. In a case where the quality x is estimated to be 1 or more, the opening degree of the expansion device 117 is fully open in a control range so that a pressure loss generated at the low-pressure side of the refrigerant circuit can be reduced.

A cooling operation (an operation in the cooling-only operation mode or the cooling main operation mode) will now be described.

[Cooling-Only Operation Mode]

Figure 5:
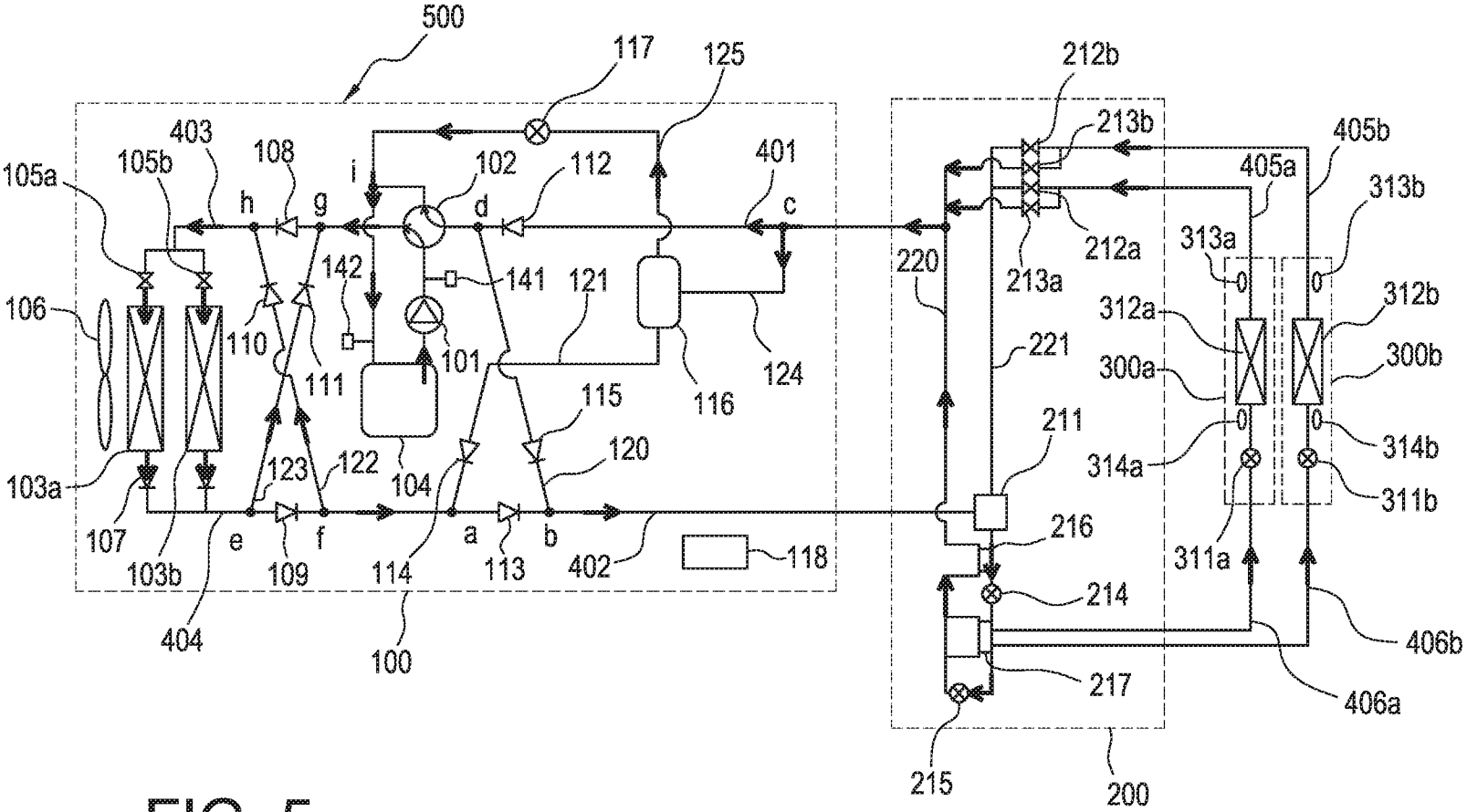
FIG. 5 is a refrigerant circuit diagram illustrating a flow of refrigerant in an operation in a cooling-only operation mode of the air-conditioning apparatus according to Embodiment of the present invention.

FIG. 5 illustrates a flow of refrigerant in the cooling-only operation mode of the air-conditioning apparatus 500 according to Embodiment 1 of the present invention. Referring to FIG. 3, an operation of the air-conditioning apparatus 500 in the cooling-only operation mode will be described.

The compressor 101 compresses low-temperature, low-pressure refrigerant to discharge high-temperature, high-pressure gas refrigerant. The high-temperature, high-pressure gas refrigerant discharged from the compressor 101 passes through the four-way switching valve 102 and flows into the heat source side heat exchangers 103. Since the heat source side heat exchangers 103 serve as condensers, the refrigerant exchanges heat with ambient air to be condensed and liquefied. Thereafter, the liquid refrigerant that has flowed out of the heat source side heat exchangers 103 passes through the connecting pipe 404 and flows out of the heat source side unit 100 by way of the check valve 113.

The high-pressure liquid refrigerant that has flowed out of the heat source side unit 100 passes through the gas-liquid separator 211 of the refrigerant control unit 200 and flows into a primary side (refrigerant inflow side) of the first refrigerant heat exchanger 216. The liquid refrigerant that has flowed into the primary side of the first refrigerant heat exchanger 216 is subjected to subcooling with refrigerant at the secondary side (refrigerant outflow side) of the first refrigerant heat exchanger 216. The pressure of the liquid refrigerant having an increased degree of subcooling is reduced to an intermediate pressure in the first expansion device 214. Then, the liquid refrigerant flows into the second refrigerant heat exchanger 217 and has its degree of subcooling further increased. Subsequently, the liquid refrigerant is branched into parts, one of which flows in the liquid pipes 406*a* and 406*b* and flows out of the refrigerant control unit 200.

The liquid refrigerant that has flowed out of the refrigerant control unit 200 flows into the load side units 300*a* and 300*b*. The liquid refrigerant that has flowed into the load side units 300*a* and 330*b* is subjected to pressure reduction in the indoor expansion devices 311*a* and 301*b* and becomes low-temperature two-phase gas-liquid refrigerant. The low-temperature two-phase gas-liquid refrigerant flows into the indoor heat exchangers 312*a* and 312*b*. Since the indoor heat exchangers 312*a* and 312*b* serve as evaporators, refrigerant exchanges heat with ambient air to be evaporated and gasified. At this time, the refrigerant takes heat from the ambient air so that the room is cooled. Thereafter, the refrigerant that has flowed out of the load side units 300*a* and 300*b* passes through the second shut-off valves 213*a* and 213*b* and merges with refrigerant that has flowed in the connecting pipe 220 through the first expansion device 214 and the second expansion device 215 to be subjected to subcooling in the second refrigerant heat exchanger 217, and the resulting refrigerant reaches the low-pressure pipe 401.

The refrigerant that has flowed in the low-pressure pipe 401 flows out of the refrigerant control unit 200 and then returns to the heat source side unit 100. The gas refrigerant that has returned to the heat source side unit 100 is sucked into the compressor 101 again through the check valve 112, the four-way switching valve 102, and the accumulator 104.

On the other hand, by opening the expansion device 117, gas refrigerant is allowed to flow into the accumulator 104 through the gas-liquid separator 116 by way of the sixth connecting pipe 125. In the cooling-only operation, the primary side of the gas-liquid separator 116 is controlled so that the degree of subcooling is larger than zero (>0), and thus, the gas-liquid separator 116 does not need to separate refrigerant into gas refrigerant and liquid refrigerant. Accordingly, the check valve 114 prevents refrigerant from passing through a liquid-side outflow pipe of the gas-liquid separator 116. By opening the expansion device 117, the channel has a pathway in which refrigerant flows into the accumulator 104 through the check valve 112 and the four-way switching valve 102 and a pathway in which refrigerant returns to the accumulator 104 through the expansion device 117. A pressure loss occurring in the channel is proportional to the 1.75th power of the flow rate. Thus, the two pathways reduce a flow rate in each pathway, the pressure loss at the low-pressure side can be reduced in the operation in the cooling-only operation mode, and power consumption can be reduced. In the foregoing manner, the air-conditioning apparatus 500 performs the cooling-only operation mode.

Control operation of the expansion device 117 will now be described. During an operation in the cooling-only operation mode, refrigerant flowing into the load side units 300 has a degree of subcooling, and thus, the opening degree of the expansion device 117 is set at maximum in the same manner as in a case where the cooling load ratio in the heating main operation is 0.5 or more. By setting the opening degree at maximum, a pressure loss occurring in the check valve 112 at the low-pressure side and the four-way switching valve 102 can be reduced so that power consumption can be reduced.

[Cooling Main Operation Mode]

Figure 6:
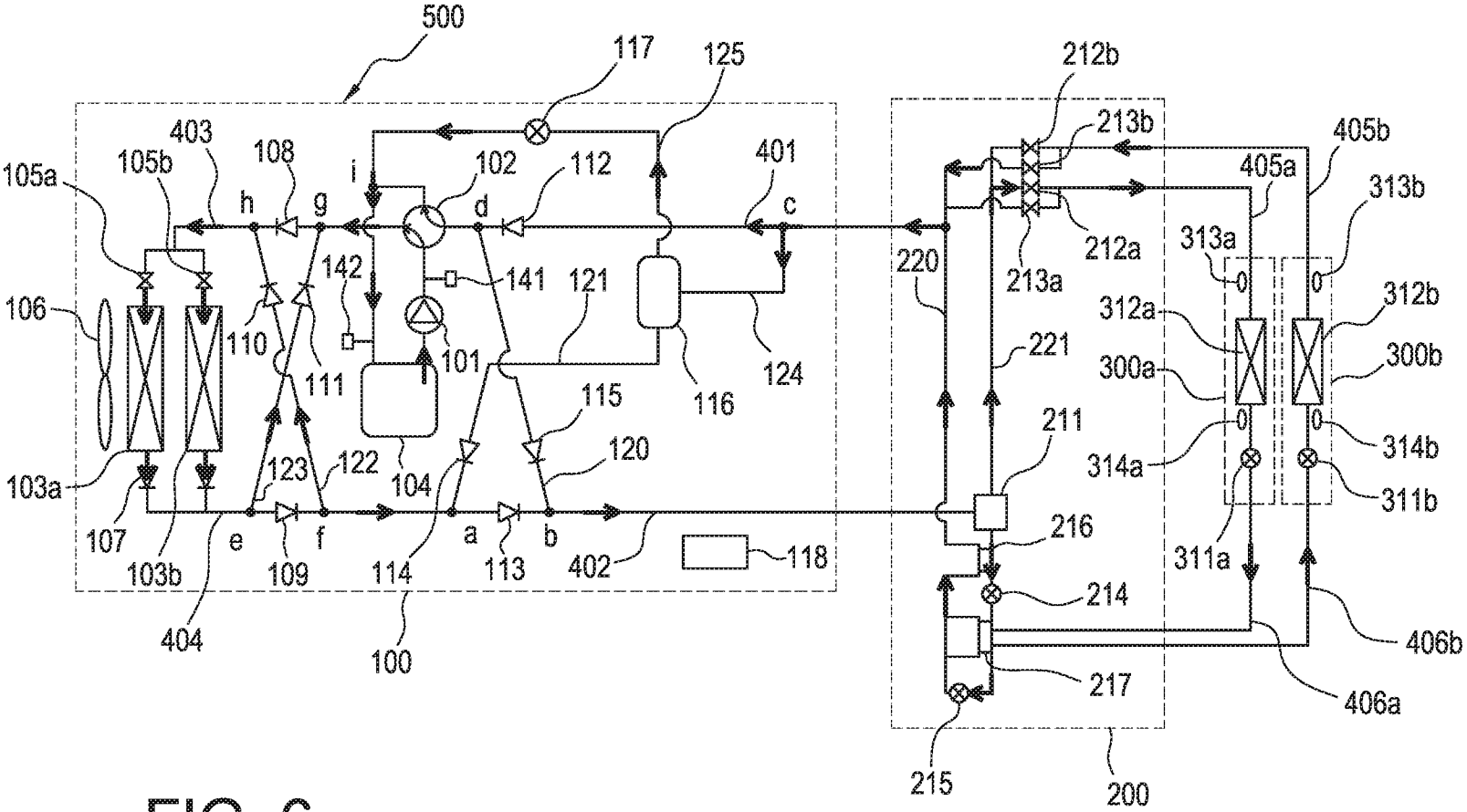
FIG. 6 is a refrigerant circuit diagram illustrating a flow of refrigerant in an operation in a cooling main operation mode of the air-conditioning apparatus according to Embodiment of the present invention.

FIG. 6 illustrates a flow of refrigerant in the cooling main operation mode of the air-conditioning apparatus 500 according to Embodiment 1 of the present invention. In a case where the load side unit 300 performing cooling and the load side unit 300 performing heating are both present and a cooling load is larger than a heating load, an operation in the cooling main operation mode is performed. Referring to FIG. 6, an operation of the air-conditioning apparatus 500 in the cooling main operation mode will be described. Here, an operation in the cooling main operation mode in a case where the load side unit 300*a* performs cooling and the load side unit 300*b* performs heating will be described.

The compressor 101 compresses low-temperature, low-pressure refrigerant and discharges the high-temperature, high-pressure gas refrigerant. The high-temperature, high-pressure gas refrigerant discharged from the compressor 101 flows into the heat source side heat exchangers 103 through the four-way switching valve 102. Since the heat source side heat exchangers 103 serve as condensers, the refrigerant exchanges heat with ambient air to be condensed and changed into two phases. Thereafter, the two-phase gas-liquid refrigerant that has flowed out of the heat source side heat exchangers 103 passes through the high-pressure pipe 402 and flows out of the heat source side unit 100 through the check valve 113.

The two-phase gas-liquid refrigerant that has flowed out of the heat source side unit 100 flows into the gas-liquid separator 211 of the refrigerant control unit 200. The two-phase gas-liquid refrigerant that has flowed into the gas-liquid separator 211 is separated into gas refrigerant and liquid refrigerant in the gas-liquid separator 211. The gas refrigerant flows out of the gas-liquid separator 211 and then flows into the connecting pipe 221. The gas refrigerant that has flowed into the second connecting pipe 121 flows into the gas pipe 405*b* through the first shut-off valve 212*b* and flows into the load side unit 300*b*. The gas refrigerant that has flowed into the load side unit 300*b* rejects heat to the ambient air in the indoor heat exchanger 312*b*, and is condensed and liquefied and flows out of the indoor heat exchanger 312*b*. The pressure of the liquid refrigerant that has flowed out of the indoor heat exchanger 312*b* is reduced to an intermediate pressure in the indoor expansion device 311*b*.

The liquid refrigerant whose pressure has been reduced to the intermediate pressure in the indoor expansion device 311*b* flows in the liquid pipe 406*b*, is separated in the gas-liquid separator 211, and merges with liquid refrigerant that has flowed through the first refrigerant heat exchanger 216 and the first expansion device 214, and the resulting refrigerant flows into the second refrigerant heat exchanger 217. The liquid refrigerant that has flowed into the second refrigerant heat exchanger 217 has its degree of subcooling increased, flows into the liquid pipe 406*a*, and flows out of the refrigerant control unit 200. The liquid refrigerant that has flowed out of the refrigerant control unit 200 flows into the load side unit 300*a*. The liquid refrigerant that has flowed into the load side unit 300*a* is subjected to pressure reduction in the indoor expansion device 311*a*, and changes to low-temperature two-phase gas-liquid refrigerant. The low-temperature two-phase gas-liquid refrigerant flows into the indoor heat exchanger 312*a* and takes heat from the ambient air so that an air-conditioned space is cooled and the refrigerant is evaporated and vaporized and the resulting refrigerant flows out of the indoor heat exchanger 312*a*.

The gas refrigerant that has flowed out of the indoor heat exchanger 312*a* flows out of the load side unit 300*a* through the gas pipe 405*a*, and then flows into the refrigerant control unit 200. The refrigerant that has flowed into the refrigerant control unit 200 merges with refrigerant that has flowed in the connecting pipe 220 through the first expansion device 214 and the second expansion device 215 for obtaining subcooling in the second refrigerant heat exchanger 217 through the second shut-off valve 213*a*, and, the resulting refrigerant reaches the low-pressure pipe 401.

The refrigerant that has flowed in the low-pressure pipe 401 flows out of the refrigerant control unit 200 and then returns to the heat source side unit 100. The gas refrigerant that has returned to the heat source side unit 100 is sucked in the compressor 101 again through the check valve 112, the four-way switching valve 102, and the accumulator 104. In the foregoing manner, the air-conditioning apparatus 500 performs the cooling main operation mode.

Control operation of the expansion device 117 will now be described. In an operation in the cooling main operation mode, in a manner similar to the operation in the cooling-only operation mode, the inlet state of the load side units 300 is controlled based on a quality 1, and thus, the expansion device 117 can be fully open in the control range. In this manner, a pressure loss generated in the check valve 112 and the four-way switching valve 102 is reduced and a decrease of suction density of the compressor 101 is reduced so that operation with energy saving can be achieved.

Embodiment 2

In Embodiment 1, gas refrigerant passes through the sixth connecting pipe 125 serving as a bypass pipe. The present invention is not limited to this example, and the opening degree of the expansion device 117 may be controlled so that part of liquid refrigerant passes through the sixth connecting pipe 125 to control the amount of refrigerant passing through the heat source side heat exchangers 103, for example. That is, the gas-liquid separator 116 does not need to be separated liquid refrigerant and gas refrigerant completely ideally. In a case where part of liquid refrigerant is allowed to flow into the joint i from the sixth connecting pipe by way of the expansion device 117 as a system, or on the contrary, in a case where part of gas refrigerant is allowed to flow from the second connecting pipe 121 to the joint i by way of the heat source side heat exchangers 103, or both of these flows are allowed, the channel resistance Cvg obtained from Equation (4) may be corrected and the corrected resistance can be used as a target.

Embodiment 3

In Embodiment 1, the shut-off valves 105*a* and 105*b* are controlled based on the rotation speed of the heat source side fan 106. Alternatively, for example, in a case where the heat source side heat exchangers 103 are water-cooled heat exchangers, control values (frequency, power consumption, current) of the water circulation pump is monitored, for example, so that the shut-off valves 105*a* and 105*b* are controlled.

In the example of Embodiment 1, the air-conditioning apparatus 500 includes one heat source side unit 100, one refrigerant control unit 200, and two load side units 300. However, the number of each unit is not specifically limited. In the example of Embodiment 1, the air-conditioning apparatus 500 capable of operating with both the load side unit 300 performing cooling and the load side unit 300 performing heating in combination is described. However, the present invention is not limited to this example. For example, the present invention is applicable to other systems constituting a refrigerant circuit using a refrigeration cycle, such as a refrigeration cycle system and a refrigeration cycle system that heat a load by supplying capacity.

REFERENCE SIGNS LIST

100 heat source side unit, 101 compressor, 102 four-way switching valve, 103, 103*a*, 103*b* heat source side heat exchanger, 104 accumulator, 105, 105*a*, 105*b* shut-off valve, 106 heat source side fan, 107, 108, 109, 110, 111, 112, 113, 114, 115 check valve, 116 gas-liquid separator, 117 expansion device, 118 controller, 120 first connecting pipe, 121 second connecting pipe, 122 third connecting pipe, 123 fourth connecting pipe, 124 fifth connecting pipe, 125 sixth connecting pipe, 141 high pressure sensor, 142 low pressure sensor, 200 refrigerant control unit, 211 gas-liquid separator, 212, 212*a*, 212*b* first shut-off valve, 213, 213*a*, 213*b* second shut-off valve, 214 first expansion device, 215 second expansion device, 216 first refrigerant heat exchanger, 217 second refrigerant heat exchanger, 220 connecting pipe, 221 connecting pipe, 300, 300*a*, 300*b* load side unit, 311, 311*a*, 311*b* indoor expansion device, 312, 312*a*, 312*b* indoor heat exchanger, 313, 313*a*, 313*b*, 314, 314*a*, 314*b* temperature sensor, 401 low-pressure pipe, 402 high-pressure pipe, 403 connecting pipe, 404 connecting pipe, 405, 405*a*, 405*b* gas pipe, 406, 406*a*, 406*b* liquid pipe, 500 air-conditioning apparatus.

The invention claimed is:

1. A heat source side unit connected to a load side unit configured to supply a capacity to a load by a pipe and constituting a refrigerant circuit, the heat source side unit comprising:

a compressor configured to compress refrigerant and discharge the refrigerant;

a heat source side heat exchanger configured to serve as an evaporator or a radiator;

a channel switching valve configured to switch a flow of the refrigerant based on a function of the heat source side heat exchanger;

a gas-liquid separator configured to separate inflow of the refrigerant into liquid refrigerant and gas refrigerant, the gas-liquid separator having a liquid refrigerant outlet from which the liquid refrigerant flows out and a gas refrigerant outlet of the gas-liquid separator from which the gas refrigerant flows out, the liquid refrigerant outlet being connected to a refrigerant inflow pipe at a refrigerant inflow side of the heat source side heat exchanger when the heat source side heat exchanger serves as the evaporator;

a bypass pipe connecting the gas refrigerant outlet of the gas-liquid separator to a refrigerant outflow pipe at a refrigerant outflow side of the heat source side heat exchanger when the heat source side heat exchanger serves as the evaporator; and a connecting pipe configured to branch the refrigerant which flows from the load side unit to the channel switching valve into two branches when the heat source side heat exchanger serves as the radiator, one of the two branches configured to flow a part the refrigerant to the channel switching valve and another of the two branches configured to flow another part of the refrigerant into the gas-liquid separator and to bypass the channel switching valve.

2. The heat source side unit of claim 1, further comprising;

an expansion device configured to control passage of the refrigerant in the bypass pipe; and a controller configured to determine a quality of the refrigerant in the refrigerant inflow side of the gas-liquid separator, wherein an opening degree of the expansion device is controlled based on the quality of the refrigerant determined by the controller.

3. The heat source side unit of claim 1, further comprising an expansion device configured to control passage of the refrigerant in the bypass pipe, wherein an opening degree of the expansion device is controlled based on a quality of the refrigerant obtained from the capacity supplied from the load side unit to the load.

4. The heat source side unit of claim 2, wherein the expansion device is controlled to allow the liquid refrigerant to flow out of the gas refrigerant outlet.

5. An air-conditioning apparatus comprising a plurality of load side units connected to the heat source side unit of claim 1, by the pipe in the refrigerant circuit.

6. The heat source side unit of claim 1, further comprising an expansion device configured to control passage of the refrigerant in the bypass pipe, wherein when the heat source side heat exchanger serves as a condenser, an opening degree of the expansion device is set at maximum.

* * * * *